US010789891B2

(12) United States Patent
Feng

(10) Patent No.: US 10,789,891 B2
(45) Date of Patent: Sep. 29, 2020

(54) PIXEL CIRCUIT, DRIVING METHOD THEREOF, DISPLAY SUBSTRATE AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan Province (CN)

(72) Inventor: Yuhsiung Feng, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 16/687,351

(22) Filed: Nov. 18, 2019

(65) Prior Publication Data

US 2020/0090592 A1 Mar. 19, 2020

Related U.S. Application Data

(63) Continuation-in-part of application No. 15/568,986, filed as application No. PCT/CN2017/076587 on Mar. 14, 2017, now Pat. No. 10,515,591.

(30) Foreign Application Priority Data

Sep. 19, 2016 (CN) ..... 2016 1 0830211

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01); *G09G 2320/0233* (2013.01)

(58) Field of Classification Search
CPC ..... G09G 3/3258; G09G 3/3233; G09G 2300/0819; G09G 2320/0233; G09G 2320/043; G09G 2300/0842
See application file for complete search history.

(56) References Cited

U.S. PATENT DOCUMENTS 10,032,415 B2 7/2018 Ma
10,157,576 B2 12/2018 Feng
(Continued)

FOREIGN PATENT DOCUMENTS

CN 1744774 A 3/2006
CN 102708792 A 10/2012
(Continued)

OTHER PUBLICATIONS

International Preliminary Report on Patentability received for PCT Patent Application No. PCT/CN2017/076587, dated Mar. 28, 2019, 12 pages (7 pages of English Translation and 5 pages of Original Document).

(Continued)

*Primary Examiner* — Kwang-Su Yang
(74) *Attorney, Agent, or Firm* — Womble Bond Dickinson (US) LLP

(57) ABSTRACT

The present disclosure provides a pixel circuit. The pixel circuit may compensate the threshold voltage of the driving unit, such that the driving current provided by the driving unit to the light emitting device is only relevant to the difference between the voltage acting on the signal input terminal acting of the driving unit and the voltage of the data signal, which thereby eliminates the influence caused by the variation of the threshold voltage of the driving unit and improves the uniformity of an displayed image. In addition, the present disclosure also relates to a driving method of the (Continued)

pixel circuit, as well as a display substrate and a display apparatus both including the pixel circuit.

20 Claims, 7 Drawing Sheets

(56) References Cited

U.S. PATENT DOCUMENTS

| | | | | |
|---|---|---|---|---|
| 2006/0055336 | A1 | 3/2006 | Jeong | |
| 2009/0115770 | A1 | 5/2009 | Lee | |
| 2014/0055325 | A1 | 2/2014 | Qi et al. | |
| 2014/0118328 | A1 | 5/2014 | Guo et al. | |
| 2015/0035448 | A1 | 2/2015 | Wang | |
| 2015/0356922 | A1 | 12/2015 | Zhu et al. | |
| 2016/0042694 | A1 | 2/2016 | Lim et al. | |
| 2016/0189606 | A1* | 6/2016 | Chen | G09G 3/3659 345/214 |
| 2016/0233281 | A1 | 8/2016 | Yoon et al. | |
| 2016/0351126 | A1 | 12/2016 | Qing et al. | |
| 2017/0047002 | A1 | 2/2017 | Xuan et al. | |
| 2017/0330511 | A1 | 11/2017 | Feng | |
| 2018/0240400 | A1* | 8/2018 | Zhou | G09G 3/3233 |

FOREIGN PATENT DOCUMENTS

| | | | |
|---|---|---|---|
| CN | 202855271 | U | 4/2013 |
| CN | 103971640 | A | 8/2014 |
| CN | 104409043 | A | 3/2015 |
| CN | 105161051 | A | 12/2015 |
| CN | 105679236 | A | 6/2016 |
| CN | 106128365 | A | 11/2016 |
| CN | 106128366 | A | 11/2016 |
| KR | 10-2008-0113823 | A | 12/2008 |

OTHER PUBLICATIONS

International Search Report received for PCT Patent Application No. PCT/CN2017/076587, dated Jun. 19, 2017, 8 pages (3 pages of English Translation and 5 pages of Original Document).

Office Action received for Chinese Patent Application No. 201610830211.7, dated Mar. 20, 2018, 6 pages (1 page of English Translation and 5 pages of Office Action).

Written Opinion received for PCT Patent Application No. PCT/CN2017/076587, dated Jun. 19, 2017, 9 pages (5 pages of English Translation and 4 pages of Original Document).

Supplementary European Search Report and Search Opinion received for EP Patent Application No. 17784823.1, dated May 12, 2020, 11 pages.

* cited by examiner

PIXEL CIRCUIT, DRIVING METHOD THEREOF, DISPLAY SUBSTRATE AND DISPLAY APPARATUS

RELATED APPLICATIONS

The present application is a continuation-in-part of U.S. patent application Ser. No. 15/568,986, which is the U.S. national phase entry of the international application PCT/CN2017/076587, with an international filing date of Mar. 14, 2017 and claiming the benefit of Chinese Patent Application No. 201610830211.7, filed on Sep. 19, 2016. The entire disclosures of these applications are incorporated herein by reference.

TECHNICAL FIELD

The present disclosure relates to the field of display technology, and more particularly to a pixel circuit, a driving method thereof, and a display substrate and a display apparatus both including the pixel circuit.

BACKGROUND

Active matrix organic light-emitting diode (AMOLED) displays are among the hot spots in today's flat panel display research. The organic light-emitting diode (OLED) has advantages such as low energy consumption, low production cost, being self-luminous, a wide viewing angle and a fast response speed, as compared with the liquid crystal display (LCD). At present, OLED displays are starting to replace traditional LCD displays in the fields of mobile phone, personal digital assistant (PDA), digital camera and the like. Pixel circuit design is the core technology of an AMOLED display, and is of important research significance.

SUMMARY

According to an aspect of the present disclosure, a pixel circuit is provided. The pixel circuit comprises: a first voltage terminal configured to be applied with a first voltage signal; a second voltage terminal configured to be applied with a second voltage signal; an initialization voltage terminal configured to be applied with an initialization voltage signal; a scan signal terminal configured to receive a scan signal; a data signal terminal configured to receive a data signal; a reset signal terminal configured to receive a reset signal; a light emitting signal terminal configured to receive a light emitting signal; a light emitting device, a storage capacitor, a driving unit, a first switching unit, a second switching unit, a third switching unit, a fourth switching unit, a fifth switching unit and a sixth switching unit, wherein: each of the switching units comprises a control terminal, a first signal terminal and a second signal terminal, the control terminal of the switching unit is operable to bring the first and second signal terminals into or out of conduction, and wherein the driving unit comprises a control terminal, a signal input terminal and a drive terminal, the control terminal and the signal input terminal of the driving unit is operable to control a drive signal outputted at the drive terminal; the control terminal of the driving unit, a first terminal of the storage capacitor, the first signal terminal of the first switching unit, the first signal terminal of the second switching unit and the control terminal of the third switching unit are connected to a first node; the control terminal of the second switching unit and the control terminal of the fifth switching unit are connected to the scan signal terminal, the second signal terminal of the second switching unit is connected with the first signal terminal of the third switching unit, the second signal terminal of the third switching unit is connected with the first signal terminal of the fifth switching unit, and the second signal terminal of the fifth switching unit is connected with the data signal terminal; the control terminal of the first switching unit and the control terminal of the sixth switching unit are connected to the reset signal terminal, and the second signal terminal of the first switching unit and the first signal terminal of the sixth switching unit are connected to the initialization voltage terminal; the control terminal of the fourth switching unit is connected to the light emitting signal terminal, a second terminal of the storage capacitor is connected to the first voltage signal terminal, a first terminal of the light emitting device and the second signal terminal of the sixth switching unit are connected to a second node, and a second terminal of the light emitting device is connected with the second voltage signal terminal; the signal input terminal and the drive terminal of the driving unit as well as the first signal terminal and the second signal terminal of the fourth switching unit are connected in series between the first voltage signal terminal and the second node, such that the driving unit and the fourth switching unit are connected in series between the first voltage signal terminal and the second node.

According to some exemplary embodiments, the driving unit and six switching units are thin film transistors, wherein: the control terminal of each of the switching units and the control terminal of the driving unit are each a gate of the thin film transistor; the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

According to some exemplary embodiments, the driving unit and the six switching units are P-type thin film transistors.

According to some exemplary embodiments, the driving unit and the six switching units are N-type thin film transistors.

According to some exemplary embodiments, the driving unit and the third switching unit are thin film transistors having the same specifications.

According to some exemplary embodiments, the light emitting device is an organic light emitting diode.

According to another aspect of the present disclosure, a display substrate is provided, comprising the pixel circuits as described above and a base substrate supporting the pixel circuits.

According to yet another aspect of the present disclosure, a display apparatus is provided, comprising the display substrate as described above.

According to a further aspect of the present disclosure, a driving method for the pixel circuit as described above is provided, wherein the driving method comprises: bringing the first and second signal terminals of the first switching unit into conduction, bringing the first and second signal terminals of the sixth switching unit into conduction, and initializing the potentials at the first node and the second node with the initialization voltage; bringing the first and second signal terminals of the second switching unit into conduction, bringing the first and second signal terminals of the fifth switching unit into conduction, and charging the storage capacitor with the data signal via the second signal terminal and the control terminal of the third switching unit to set the potential at the first node; and bringing the first and second signal terminals of the fourth switching unit into conduction, and driving the light emitting device by the driving unit.

According to some exemplary embodiments, the driving unit is a thin film transistor, and wherein, when driving the light emitting device, the thin film transistor serving as the driving unit is in a saturated state.

BRIEF DESCRIPTION OF THE DRAWINGS

The drawings are used to provide a further understanding of the technical solutions of the present disclosure, which constitutes a part of the specification, and are used, together with the exemplary embodiments of the present disclosure, to explain the technical solutions of the present disclosure, which, however, do not constitute any limitation to the technical solutions of the present disclosure; wherein.

It shall be noted that the drawings are not necessarily drawn in proportion. Moreover, identical or similar parts, components and/or elements are indicated by the same reference numerals throughout the drawings.

DETAILED DESCRIPTION OF THE INVENTION

Figure 1:
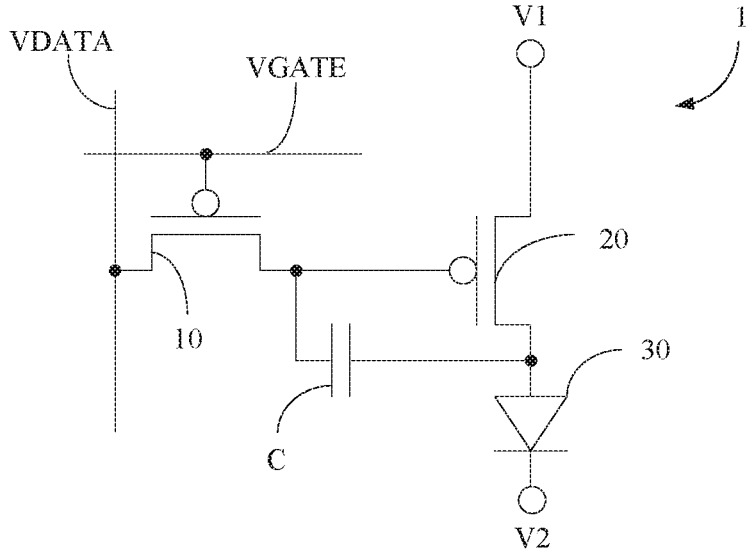
FIG. 1 shows a structural schematic diagram of a prior art pixel circuit.

In the following, the technical solutions in exemplary embodiments of the disclosure will be described clearly and completely in connection with the drawings in the exemplary embodiments of the disclosure. Obviously, the described exemplary embodiments are only part of the embodiments of the disclosure, and not all of the embodiments. Based on the exemplary embodiments in the disclosure, all other embodiments obtained by those of ordinary skills in the art under the premise of not paying out creative work pertain to the protection scope of the disclosure.

It will be understood that although terms such as "first", "second" and the like can be used for describing various elements, components and/or parts herein, the elements, components and/or parts should not be limited by these terms. These terms are only used for distinguishing an element, a component or a part from another element, another component or another part. Therefore, the first element, component or part discussed below may also be referred as second or third element, component or part without deviating from the teaching of this disclosure.

The terms used herein are used only for describing exemplary embodiments rather than limiting this disclosure. As used herein, the singular forms of "one", "a" and "the" are intended to include the plural forms too, unless explicitly indicated otherwise in the context. It should also be understood that when used in this specification, the terms of "comprise" and/or "include" refer to the presence of features, entireties, steps, operations, elements and/or components that are mentioned, but do not exclude the presence or the addition of one or more other features, entireties, steps, operations, elements, components and/or groups thereof. Moreover, the term of "and/or" herein comprises any and all combination of one or more of the listed items that are associated.

It should be understood that when an element is described as being "connected to another element" or "coupled to another element", it can be connected or coupled to another element directly, or there can be an intermediate element. In contrast, when an element is described as being "directly connected to another element" or "directly coupled to another element", there is no intermediate element.

It will be understood that in this context, when A and B are described as "bring A and B into conduction" or "turning on the conduction between A and B", it should be understood that electrical communication between A and B is realized. That is, the electrical signal can be transmitted between A and B. Accordingly, when A and B are described as "breaking the conduction between A and B" or "turning off the conduction between A and B", it should be understood that the electrical communication between A and B is disconnected. That is, the electrical signal cannot be transmitted between A and B. But at this time, A and B may be physically disconnected from each other, or may be still physically connected to each other. In the above, A and B may be any suitable elements, components, parts, ports or signal terminals, and the like.

Unless otherwise defined, all terms (including technical terms and scientific terms) used herein have the same meaning as commonly understood by one having ordinary skills in the art. It should also be understood that terms such as those defined in a common dictionary should be construed as having the same meaning as in the related art and/or in the context of this specification, and will not be construed in an ideal or overly formal sense, unless defined explicitly as such herein.

It should be noted that, in the description of the specification of the present application, expressions referring to "an embodiment", "some embodiments", "exemplary embodiments", "specific examples" or "some examples" are intended to mean that specific features, structures, materials or characteristics described with reference to the embodiments or examples are contained in at least one embodiment or example of this disclosure. Therefore, schematic descriptions with respect to the above expressions herein do not have to be directed at the same embodiments or examples herein. Instead, specific features, structures, materials or characteristics described thereby can be combined in a suitable manner in any one or more embodiments or examples. Besides, where no contradiction is caused, those skilled in the art can combine and assemble different embodiments or examples described in the specification and features of different embodiments or examples.

It should be noted that the steps involved in the method described in the present disclosure are exemplary, and are not necessarily to be implemented in the order as listed. Instead, one or more of these steps may be implemented in a different order or simultaneously according to actual situations. Furthermore, the described method may also comprise other additional steps according to actual situations.

It should be noted that the term "active potential" used herein refers to a potential at which a circuit element (e.g., a transistor) involved is enabled, and the term "inactive potential" used herein refers to a potential at which the circuit element involved is disabled. As for an N-type transistor, an active potential is a high potential and an inactive potential is a low potential. As for a P-type transistor, an active potential is a low potential and an inactive potential is a high potential. It shall be understood that an active potential or an inactive potential does not intend to refer to a specific potential, but may comprise a range of potentials. In addition, the terms "level", "voltage" and "potential" herein may be used interchangeably Some techniques, structures and materials commonly known in the art of this disclosure are not described in detail for the sake of clarity so as to avoid making the present application tediously long.

FIG. 1 schematically illustrates the structure of a prior art OLED pixel circuit 1. Unlike thin film transistor liquid crystal displays (TFT-LCDs) which use a stable voltage for brightness control, the OLED display requires a steady current to control the light emission since the OLED is a current-driven type of device. Thus, the pixel circuit 1 includes one transistor 10, one driving transistor 20, one storage capacitor C and one OLED 30. When the scan signal provided by the scan signal line VGATE is active, the transistor 10 utilizes the voltage of the data signal provided by the data line VDATA to charge the storage capacitor C. Then, the driving transistor 20 generates a driving current $I_{OLED}$ based upon a voltage across the gate and the source of the driving transistor. The driving current $I_{OLED}$ is a current generated by applying the voltage of the data signal provided by the data line VDATA to the driving transistor 20 to make it operate in a saturation region, which current drives the OLED 30 to emit light. The driving current $I_{OLED}$ is calculated as $I_{OLED}=K(V_{GS}-Vth)^2$, where $V_{GS}$ is the voltage across the gate and the source of the driving transistor 20, and Vth is a threshold voltage of the driving transistor 20.

There is non-uniformity among the threshold voltages Vth of the driving transistors 20 of the pixels due to the fabrication process and the aging of the devices. This leads to a variation among the currents flowing through the OLEDs of individual pixels, thus affecting the display effect of the entire image.

The exemplary embodiments of the present disclosure provide a pixel circuit, a driving method thereof, a display substrate and a display apparatus both including the pixel circuit, which may avoid an influence of a threshold voltage drift of the driving unit on the driving current of the active light emitting device, thereby resulting in improvement of the uniformity of the display image.

Figure 2:
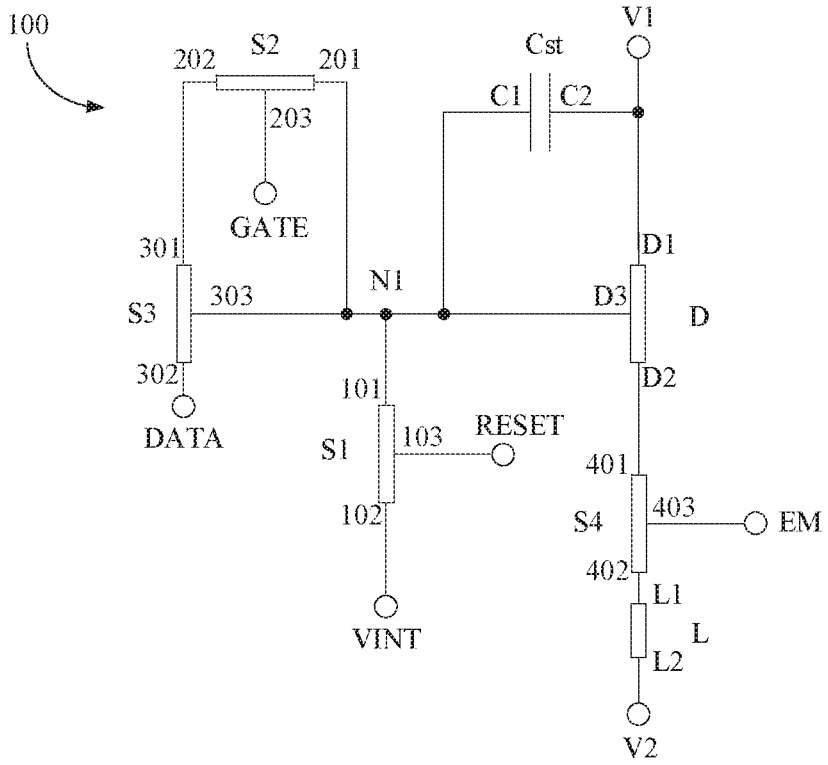
FIG. 2 shows a structural schematic diagram of a pixel circuit provided in an exemplary embodiment of the present disclosure.

As shown in FIG. 2, it schematically illustrates a pixel circuit 100 provided in an exemplary embodiment of the present disclosure. The pixel circuit 100 includes a light emitting device L, a storage capacitor Cst, a driving unit D, and four switching units S1, S2, S3 and S4. Each of the switching units includes a control terminal, a first signal terminal and a second signal terminal. The control terminal of the switching unit is used to bring the first and second signal terminals into or out of conduction. The driving unit D includes a control terminal D3, a signal input terminal D1 and a drive terminal D2. The control terminal D3 and the signal input terminal D1 of the driving unit D are used to control a drive signal outputted at the drive terminal D2. The control terminal D3 of the driving unit D, a first terminal C1 of the storage capacitor Cst, the first signal terminal 101 of a first switch unit S1, the first signal terminal 201 of a second switching unit S2, and the control terminal 303 of a third switching unit S3 are connected with each other, i.e. are all connected to a first node N1. The control terminal 103 of the first switching unit S1 is connected to a reset signal terminal RESET. The second signal terminal 102 of the first switching unit S1 is connected to an initialization voltage terminal VINT. The control terminal 203 of the second switching unit S2 is connected to a scan signal terminal GATE. The second signal terminal 202 of the second switching unit S2 is connected with the first signal terminal 301 of the third switch unit S3. The second signal terminal 302 of the third switching unit S3 is connected to a data signal terminal DATA. The control terminal 403 of a fourth switching unit S4 is connected to a light emitting signal terminal EM. The signal input terminal D1 of the driving unit D is connected to a second terminal C2 of the storage capacitor Cst and a first voltage terminal V1. The drive terminal D2 of the driving unit D is connected to the first signal terminal of the fourth switching unit S4. The second signal terminal 402 of the fourth switching unit S4 is connected to the first terminal L1 of the light emitting device L. A second terminal L2 of the light emitting device L is connected to a second voltage terminal V2.

Figure 4:
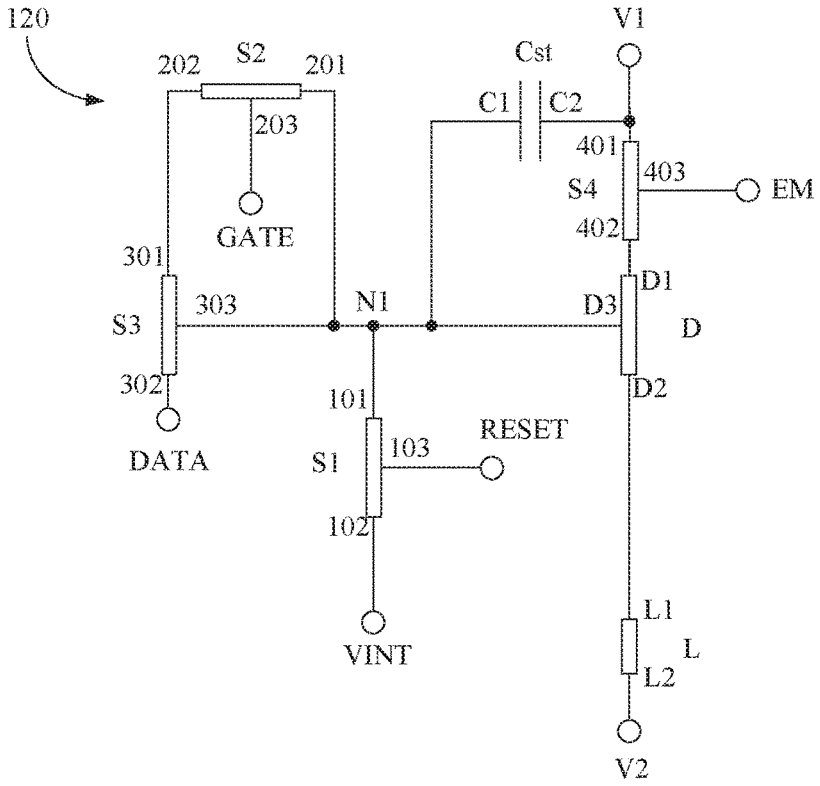
FIG. 4 shows a structural schematic diagram of a pixel circuit provided in another exemplary embodiment of the present disclosure.

Alternatively, as shown in FIG. 4, it schematically illustrates another pixel circuit 120 provided in an exemplary embodiment of the present disclosure. In the pixel circuit 120, the first signal terminal 401 of the fourth switching unit S4 is connected to the second terminal C2 of the storage capacitor Cst and the first voltage terminal V1, the second signal terminal 402 of the fourth switch unit S4 is connected to the signal input terminal D1 of the driving unit D, and the driving terminal D2 of the driving unit D is connected to the first terminal L1 of the light emitting device L. The other parts of the pixel circuit 120 as shown in FIG. 4 are identical to the corresponding parts of the pixel circuit 100 as shown in FIG. 2, and thus will not be described in detail herein.

It should be noted that, in all pixel circuits provided in the exemplary embodiments of the present disclosure, the first voltage terminal V1 is configured to be applied with a first voltage signal, the second voltage terminal V2 is configured to be applied with a second voltage signal, the initialization voltage terminal VINT is configured to be applied with an initialization voltage signal, the scan signal terminal GATE is configured to receive a scan signal, the data signal terminal DATA configured to receive a data signal, the reset signal terminal RESET is configured to receive a reset signal, the light emitting signal terminal EM is configured to receive a light emitting signal, which will not be repeated hereinafter.

In the pixel circuits 100, 120 provided in the exemplary embodiments of the present disclosure, the difference between the voltage of the data signal at the data signal terminal DATA and the threshold voltage of the third switching unit S3 can be written into the control terminal D3 of the driving unit D (that is, using the difference between the voltage of the data signal at the data signal terminal DATA and the threshold voltage of the third switching unit S3 to set the potential at the first node N1) before the light emitting device L emits light, thereby eliminating the influence of the variation in the threshold voltage Vth of the driving unit D on the light emission. Moreover, a circuit configuration can be achieved with a relatively small storage capacitor.

Figure 3:
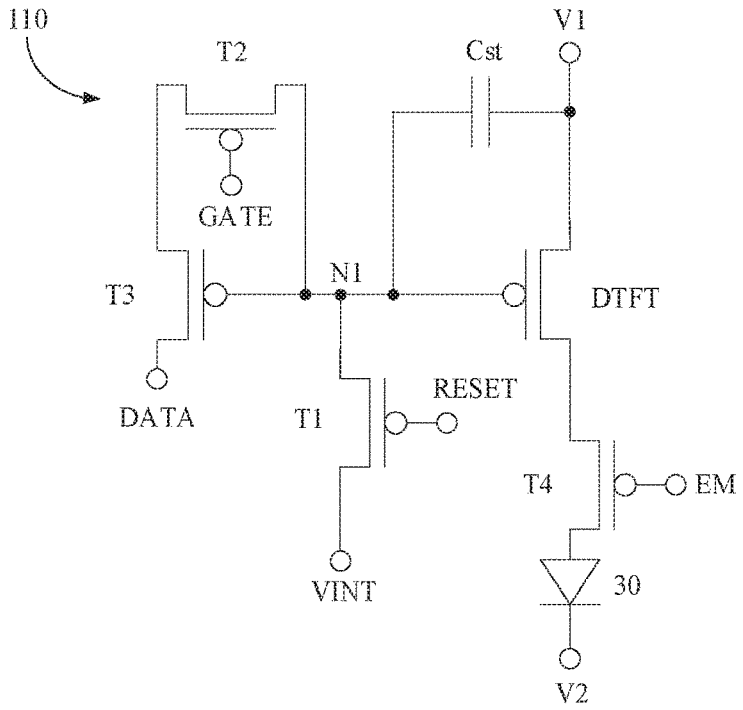
FIG. 3 shows a structural schematic diagram of a pixel circuit provided in another exemplary embodiment of the present disclosure.

Optionally, as shown in FIG. 3, it schematically illustrates another pixel circuit 110 provided in an exemplary embodiment of the present disclosure. The pixel circuit 110 only differs from the pixel circuit 100 as shown in FIG. 2 in that: the light emitting device L is implemented as an organic light emitting diode 30, the driving unit D and the four switching units S1, S2, S3 and S4 are respectively implemented as the driving transistor DTFT and the thin film transistors T1, T2, T3 and T4.

Figure 5:
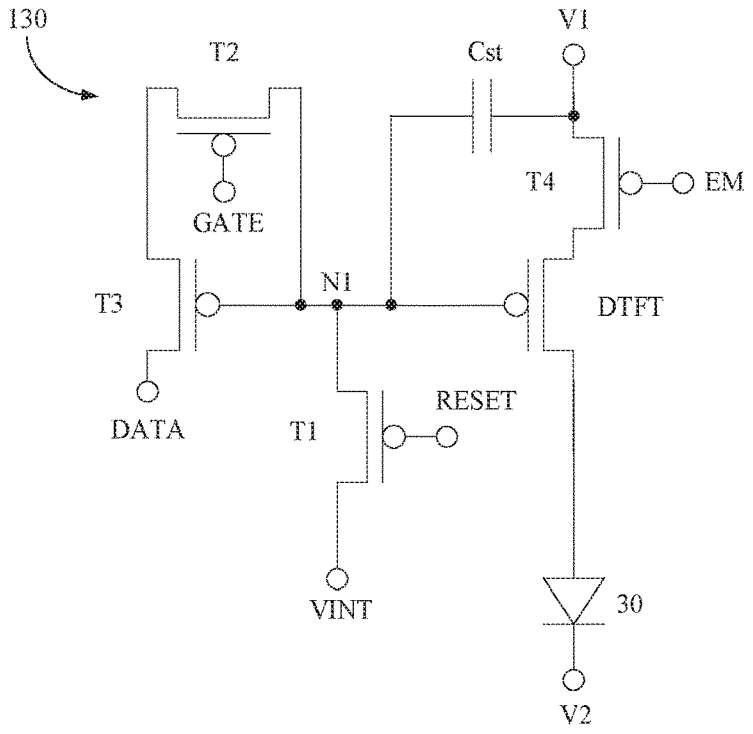
FIG. 5 shows a structural schematic diagram of a pixel circuit provided in another exemplary embodiment of the present disclosure.

Optionally, as shown in FIG. 5, it schematically illustrates another pixel circuit 130 provided by an exemplary embodiment of the present disclosure. Similarly, the pixel circuit 130 only differs from the pixel circuit 120 as shown in FIG. 4 in that the light emitting device L is implemented as the organic light emitting diode 30, and the driving unit D and the four switching units S1, S2, S3 and S4 are respectively implemented as the driving transistor DTFT and the transistors T1, T2, T3 and T4.

Thus, each of the pixel circuits 100, 110, 120 and 130 provided by the above exemplary embodiments of the present disclosure is realized by a storage capacitor, a driving unit (or a driving transistor) and four switching units (or four thin-film transistors), which not only compensates for the threshold voltage of the driving unit (or driving transistor), but also realizes a smaller pixel layout, which facilitates enhancing display resolution.

Figure 6:
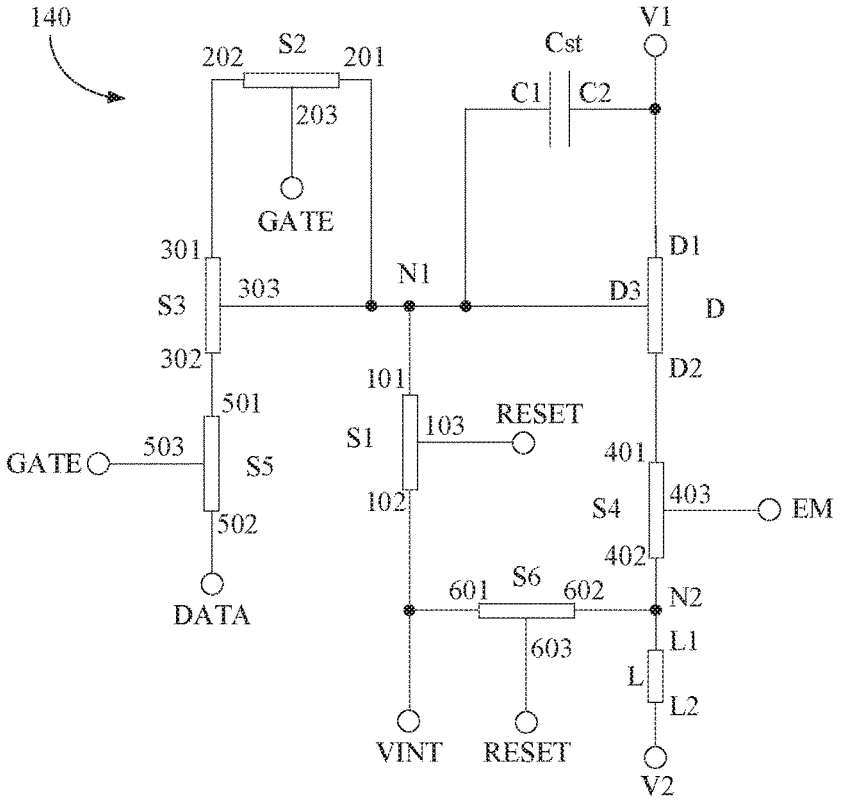
FIG. 6 shows a structural schematic diagram of a pixel circuit provided in another exemplary embodiment of the present disclosure.

Now with reference to FIG. 6, it schematically illustrates another pixel circuit 140 provided by an exemplary embodiment of the present disclosure. The pixel circuit 140 as shown in FIG. 6 only differs from the pixel circuit 100 as shown in FIG. 2 in that it further comprises a fifth switching unit S5 and a sixth switching unit S6. The first signal terminal of the fifth switching unit S5 is connected with the second signal terminal 302 of the third switching unit S3, the second signal terminal 502 thereof is connected with the data signal terminal DATA, and the control terminal 503 thereof is connected with the scan signal terminal GATE. The first signal terminal 601 of the sixth switching unit S6 is connected with the initialization voltage terminal VINT, the control terminal 603 thereof is connected with the reset signal terminal RESET, and the second signal terminal 602 thereof is connected with the second node N2 (that is, connected with the first terminal L1 of the light emitting device L).

Figure 7:
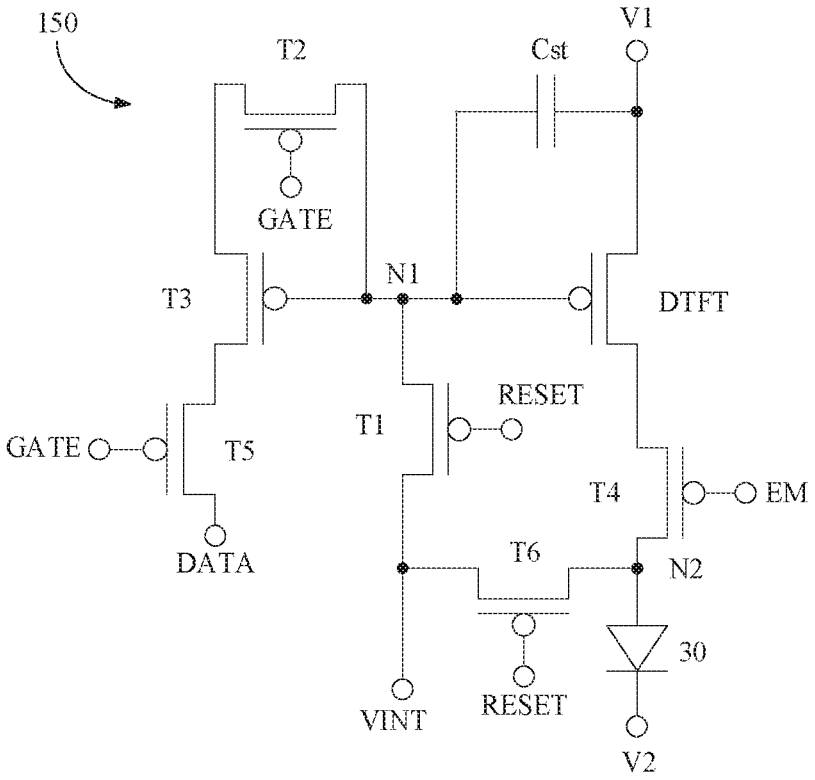
FIG. 7 shows a structural schematic diagram of a pixel circuit provided in another exemplary embodiment of the present disclosure.

As shown in FIG. 7, it schematically illustrates another pixel circuit provided by an exemplary embodiment of the present disclosure. The pixel circuit 150 only differs from the pixel circuit 140 as shown in FIG. 6 in that the light emitting device L is implemented as the organic light emitting diode 30, the driving unit D is implemented as the driving transistor DTFT, and the six switching units S1, S2, S3, S4, S5 and S6 are implemented as the transistors T1, T2, T3, T4, T5 and T6.

Figure 8:
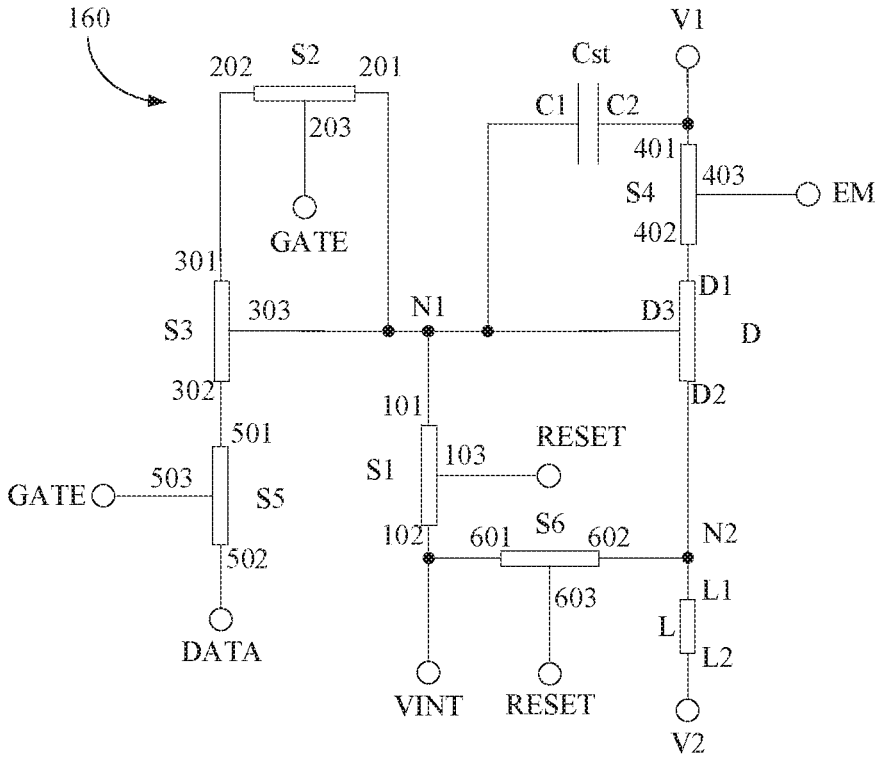
FIG. 8 shows a structural schematic diagram of a pixel circuit provided in another exemplary embodiment of the present disclosure.

With reference to FIG. 8, it schematically illustrates another pixel circuit 160 provided by an exemplary embodiment of the present disclosure. Similarly, the pixel circuit 160 as shown in FIG. 8 only differs from the pixel circuit 120 as shown in FIG. 4 in that it further comprises a fifth switching unit S5 and a sixth switching unit S6. The first signal terminal 501 of the fifth switching unit S5 is connected with the second signal terminal 302 of the third switching unit S3, the second signal terminal 502 thereof is connected with the data signal terminal DATA, and the control terminal 503 thereof is connected with the scan signal terminal GATE. The first signal terminal 601 of the sixth switching unit S6 is connected with the initialization voltage terminal VINT, the control terminal 603 thereof is connected with the reset signal terminal RESET, and the second signal terminal 602 thereof is connected with the second node N2 (that is, connected with the first terminal L1 of the light emitting device L).

Figure 9:
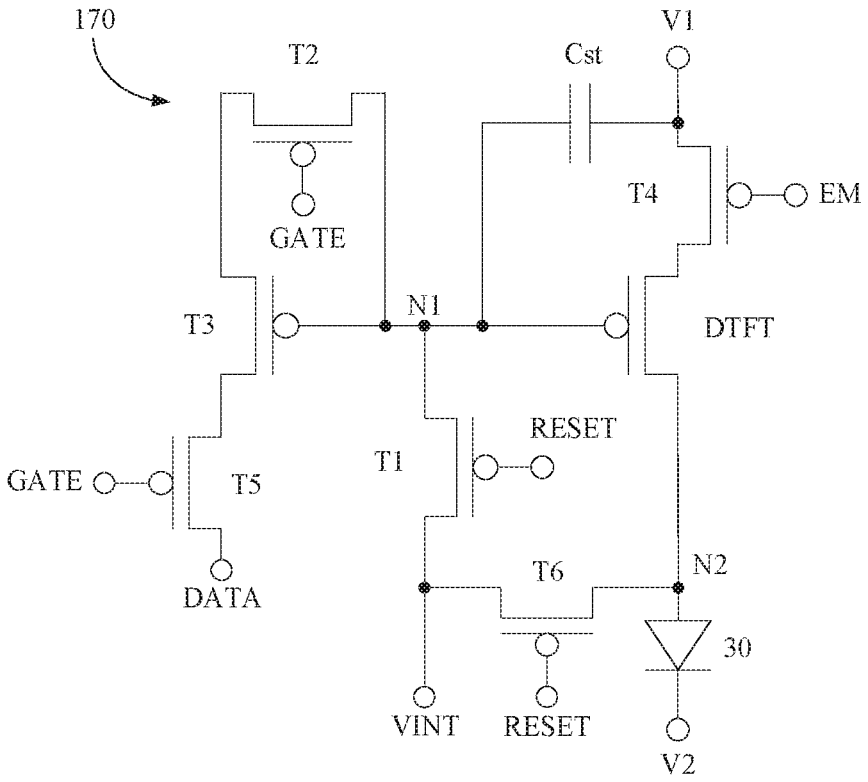
FIG. 9 shows a structural schematic diagram of a pixel circuit provided in another exemplary embodiment of the present disclosure.

As shown in FIG. 9, it schematically illustrates another pixel circuit provided by an exemplary embodiment of the present disclosure. Similarly, the pixel circuit 170 only differs from the pixel circuit 160 as shown in FIG. 8 in that the light emitting device L is implemented as the organic light emitting diode 30, the driving unit D is implemented as the driving transistor DTFT, and the six switching units S1, S2, S3, S4, S5 and S6 are implemented as the transistors T1, T2, T3, T4, T5 and T6.

It can thus be seen that in comparison with the pixel circuits 100, 110, and 130 as shown in FIGS. 2 to 5, the pixel circuits 140, 150, 160 and as shown in FIGS. 6 to 9 are added with the fifth switching unit S5 or the fifth transistor T5, and with the sixth switching unit S6 or the sixth transistor T6.

By adding the fifth switching unit S5 or the fifth transistor T5, it is possible to make the second signal terminal 302 of the third switching unit S3 or the source or drain of the third transistor T3 brought into conduction with the data signal terminal DATA only when the scan signal Gate received at the scan signal terminal GATE is active, so that the data signal acts on the first node N1. Thus, the fifth switching unit S5 or the fifth transistor T5 enhances the insulation between the data signal terminal DATA and the first node N1, in such a way to reduce the interference of the data signal to the potential at the first node N1 and further to the driving current $I_{OLED}$.

The contrast of a displayed image may be improved by adding the sixth switching unit S6 or the sixth transistor T6. Since the potential of the initialization voltage terminal VINT is lower than the potential of the second voltage terminal V2, and there is always a path for the passage of leak currents between the second signal terminal and the control terminal of the sixth switching unit S6 or between the gate and the source or drain of the sixth transistor T6, a small part of the driving current $I_{OLED}$ flowing towards the OLED will be shunted to flow through the sixth switching unit S6 or the sixth transistor T6. When the driving current $I_{OLED}$ is small, e.g., when a low-brightness image (such as a black or nearly black image) is displayed, the shunting effect will influence the brightness of the OLED obviously, such that the current flowing through the OLED is smaller and thereby the brightness of the OLED becomes lower; however, when the driving current $I_{OLED}$ is large, e.g., when a high-brightness image is displayed, since the driving current $I_{OLED}$ is far greater than the shunted leak current, the shunting effect will not influence the brightness of the OLED. It can thus be seen that the shunting effect may be advantageous. For instance, when the pixel circuit displays a low-brightness image (such as a black or nearly black image), the shunting effect renders the brightness of the OLED lower, and when the pixel circuit displays a high-brightness image, the shunting effect does not influence the brightness of the OLED. Hence, the shunting effect of the sixth switching unit S6 or the sixth transistor T6 may improve the display effect of the low-brightness image, and thereby improve the contrast of the displayed image.

In addition, similar to the pixel circuits 100, 110, 120 and 130 as stated above, in the pixel circuits 140, 150, 160 and 170 provided by the exemplary embodiments of the present disclosure, before the light emitting device illuminates, the difference between the voltage Vdata of the data signal from the data signal terminal DATA and the threshold voltage Vth3 of the third switching unit S3 or the third transistor T3 may be written into the gate of the thin-film transistor serving as the driving unit D (i.e., the difference between the voltage Vdata of the data signal at the data signal terminal DATA and the threshold voltage Vth3 of the third switching unit S3 or the third transistor T3 is used to set the potential at the first node N1), so as to eliminate the impact on illumination caused by the variation of the threshold voltage Vth of the driving unit D or the driving transistor DTFT, and also to realize a circuit structure by a relatively small storage capacitor Cst. Thus, the pixel circuits 140, 150, 160 and 170 provided by the exemplary embodiments of the present disclosure may realize a smaller pixel layout, enhance the display resolution, improve the uniformity of a displayed image and increase the contrast of a displayed image.

It can be easily appreciated that, in the pixel circuits provided by the exemplary embodiments of the present disclosure, the driving transistor and the transistors may be thin film transistors. Therefore, the control terminals of each switching unit and the driving unit are the gates of the thin film transistors. The first signal terminal and the second signal terminal of each switching unit are the source and the drain of the thin film transistor, respectively. Alternatively, the first signal terminal and the second signal terminal of each switching unit are the drain and the source of the thin film transistor, respectively. The signal input terminal and the drive terminal of the driving unit are the source and the drain of the thin film transistor, respectively. Alternatively, the signal input terminal and the drive terminal of the driving unit are the drain and the source of the thin film transistor, respectively.

Optionally, in the pixel circuits provided by the exemplary embodiments of the present disclosure, both the driving unit and the switching units are P-type thin film transistors. Alternatively, the driving unit and the switching units are N-type thin film transistors.

It needs to be noted that the switch units and the driving unit employed in the exemplary embodiments of the present disclosure may also be field effect transistors or other devices having the same characteristics. Being symmetrical, the source and drain of the thin film transistor are thus interchangeable. In the exemplary embodiments of the present disclosure, in order to distinguish between the two electrodes of the thin film transistor other than its gate, one of them is referred to as a source, and the other as a drain. According to the configurations in the figures, the middle terminal of the thin film transistor is the gate, the signal input terminal is the source, and the signal output terminal is the drain. The P-type thin film transistor is turned on when the gate is at a low voltage and is turned off when the gate is at a high voltage. The N-type thin film transistor is turned on when the gate is a high voltage and is turned off when the gate is at a low voltage. The P-type thin film transistor that serves as the driving unit is in an amplified state or a saturated state when the gate voltage is a low voltage (the gate voltage is smaller than the source voltage) and the absolute value of the voltage difference between the gate and the source is larger than the threshold voltage. The N-type thin film transistor that serves as the driving unit is in an amplified state or a saturated state when the gate voltage is a high voltage (the gate voltage is larger than the source voltage) and the absolute value of the voltage difference between the gate and the source is larger than the threshold voltage.

Optionally, the driving unit D and the third switch unit S3 are thin film transistors having the same specifications.

The threshold voltages of thin film transistors having the same specifications have the same tendency to vary. That is, in this case, the threshold voltage Vth3 of the thin film transistor that serves as the third switching unit is substantially equal to the threshold voltage Vthd of the thin film transistor that serves as the driving unit.

When the thin-film transistor serving as the driving unit is in a saturation state, the current outputted thereby is $$I_{OLED}=\tfrac{1}{2}\beta[V_{GS}-Vthd]^2=\tfrac{1}{2}\beta[VDD-V\text{data}+Vth3-Vthd]^2=\tfrac{1}{2}\beta[VDD-V\text{data}]^2,$$

wherein $V_{GS}$ is the voltage between the gate and source of the thin-film transistor, $\beta=\mu C_{ox}W/L$, $\mu$ and $C_{ox}$ are process constants, W is the channel width of the thin-film transistor, L is the channel length of the thin-film transistor, and W and L are constants that can be selectively designed. As known from the above formula, when the thin-film transistor serving as the third switching unit writes the difference (Vdata−Vth3) between the voltage Vdata of the data signal and its threshold voltage Vth3 into the first terminal of the storage capacitor (or the first node N1), since Vth3≈Vthd, the threshold voltage Vthd of the driving unit counteracts the threshold voltage Vth3 of the third switching unit, such that the driving current $I_{OLED}$ is only relevant to the voltage VDD at the first voltage terminal V1 and the voltage Vdata at the data signal terminal DATA. Thus, the driving current is not influenced by the threshold voltage Vthd of the thin-film transistor serving as the driving unit, and the current on the light emitting device L or the organic light-emitting diode 30 is also irrelevant to the threshold voltage Vthd of the thin-film transistor serving as the driving unit.

Figure 10:
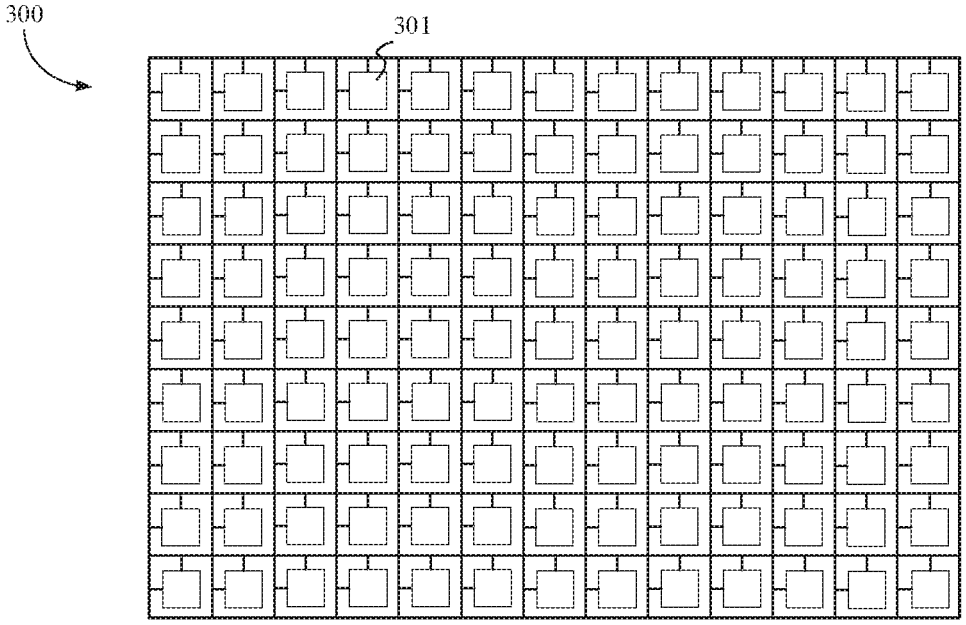
FIG. 10 shows a structural schematic diagram of a display substrate provided in an exemplary embodiment of the present disclosure.

According to another aspect of the present disclosure, an embodiment of the present disclosure further provides a display substrate. As shown in FIG. 10, the display substrate 300 includes a plurality of pixel circuits 301. Each of the pixel circuits 301 can be implemented as the pixel circuit 100, 110, 120, 130, 140, 150, 160 or 170 as described above. Of course, the display substrate 300 may further include a base substrate for supporting the pixel circuits 301, gate lines, data lines, and the like, which are not limited here.

Figure 11:
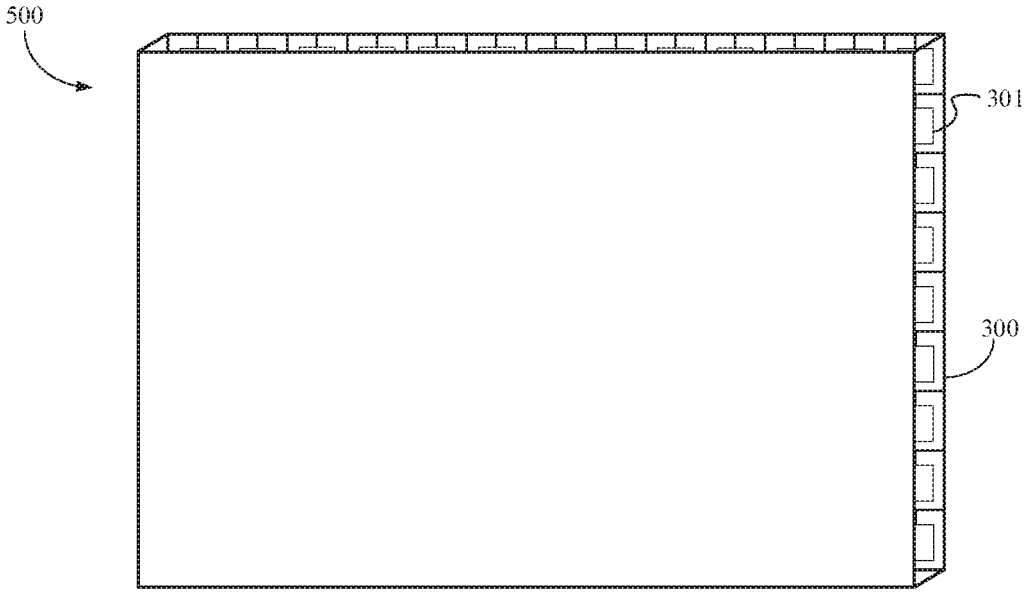
FIG. 11 shows a structural schematic diagram of a display apparatus provided in an exemplary embodiment of the present disclosure.

According to yet another aspect of the present disclosure, an exemplary embodiment of the present disclosure provides a display apparatus. As shown in FIG. 11, the display apparatus 500 includes the display substrate 300 as described in the above exemplary embodiment. As a non-limiting example, the display apparatus 500 may be applied to a mobile phone, a tablet computer, a TV, a display, a laptop computer, a digital photo frame, a navigator, etc. The present disclosure imposes no limitation to the specific application of the display apparatus 500.

Figure 12:
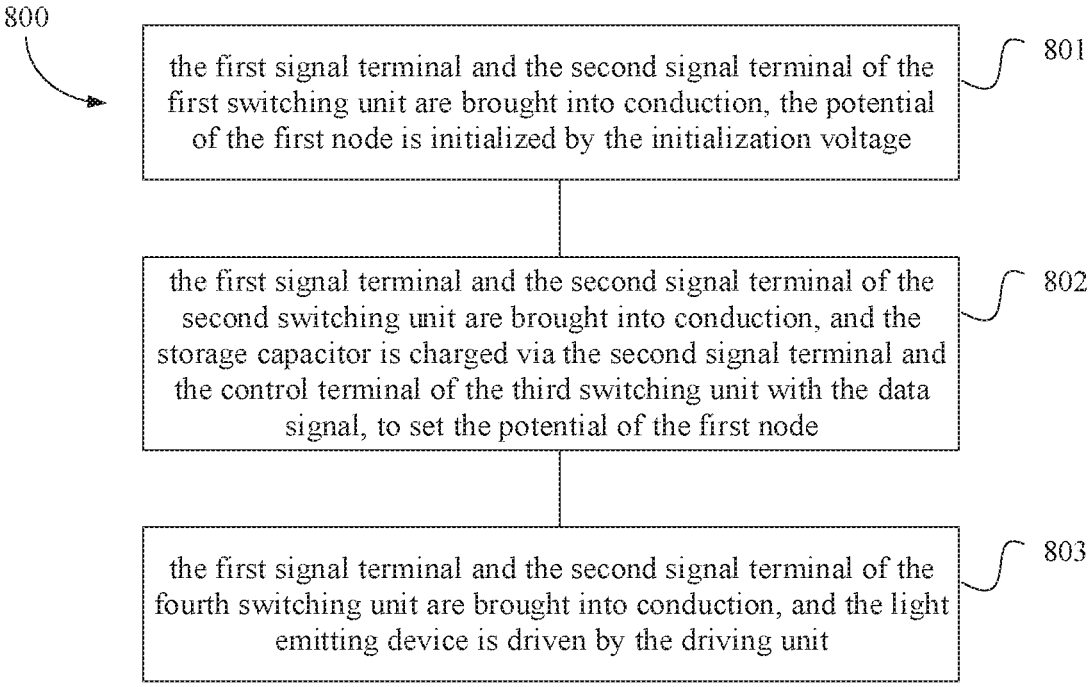
FIG. 12 shows a flow chart of a driving method applicable to the pixel circuits provided in some exemplary embodiments of the present disclosure.

With reference to FIG. 12, it illustrates a driving method 800 provided by an exemplary embodiment of the present disclosure, the driving method may be used for the pixel circuits 100, 110, 120 and 130 as described above. As shown in FIG. 12, the driving method 800 includes:

step 801: the first signal terminal and the second signal terminal of the first switching unit are brought into conduction, the potential of the first node N1 is initialized by the initialization voltage;

step 802: the first signal terminal and the second signal terminal of the second switching unit are brought into conduction, and the storage capacitor is charged via the second signal terminal and the control terminal of the third switching unit with the data signal, to set the potential of the first node N1; and step 803: a first signal terminal and the second signal terminal of the fourth switching unit are brought into conduction, and the light emitting device is driven by the driving unit.

Figure 13:
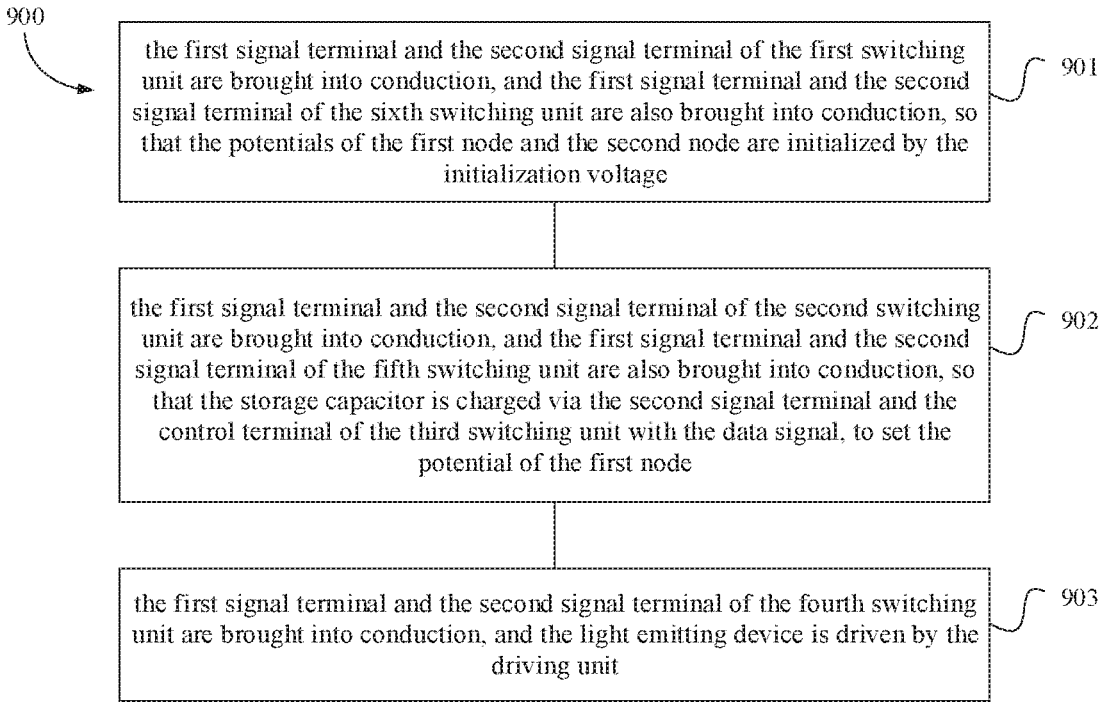
FIG. 13 shows a flow chart of another driving method applicable to the pixel circuit provided in some exemplary embodiment of the present disclosure.

With reference to FIG. 13, it illustrates a driving method 900 provided by an exemplary embodiment of the present disclosure, the driving method may be used for the pixel circuits 140, 150, 160 and 170 as described above. As shown in FIG. 13, the driving method 900 includes:

step 901: the first signal terminal and the second signal terminal of the first switching unit are brought into conduction, and the first signal terminal and the second signal terminal of the sixth switching unit are also brought into conduction, so that the potentials of the first node N1 and the second node N2 are initialized by the initialization voltage;

step 902: the first signal terminal and the second signal terminal of the second switching unit are brought into conduction, and the first signal terminal and the second signal terminal of the fifth switching unit are also brought into conduction, so that the storage capacitor is charged via the second signal terminal and the control terminal of the third switching unit with the data signal, to set the potential of the first node N1; and step 903: a first signal terminal and the second signal terminal of the fourth switching unit are brought into conduction, and the light emitting device is driven by the driving unit.

With the driving methods of the pixel circuits provided in the embodiments of the present disclosure, the difference between the voltage Vdata at the data signal terminal DATA and the threshold voltage Vth3 of the third switching unit S3 or the third transistor T3 can be written into the control terminal of the driving unit D or the gate of the driving transistor DTFT before the light emitting device L or the OLED 30 emits light, thereby eliminating the effect of the change in the threshold voltage Vth of the driving unit D or the driving transistor DTFT on the light emission. Moreover, a circuit configuration can be achieved with a relatively small storage capacitor, so as to realize a smaller pixel layout and enhance the display resolution.

Figure 14:
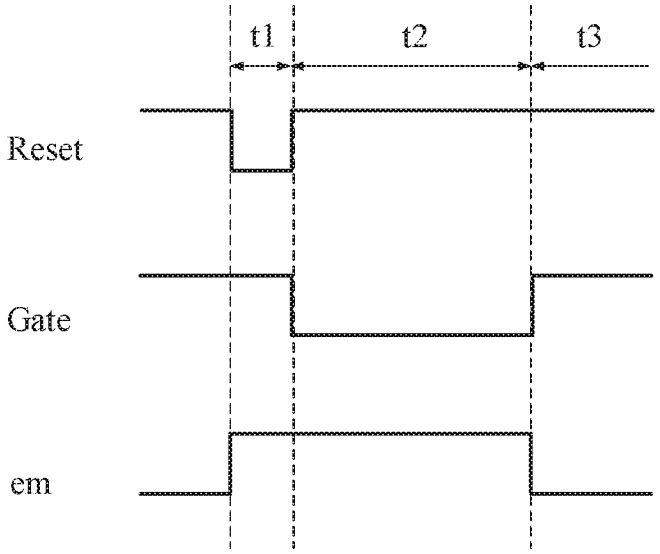
FIG. 14 shows a timing sequence diagram applicable to the pixel circuits provided in the exemplary embodiments of the present disclosure.

With reference to FIG. 14, it illustrates the schematic diagram of the input signal timing sequence for use in the pixel circuits provided by the exemplary embodiments of the present disclosure.

To be specific, the working principle of the pixel circuits provided by the exemplary embodiments of the present disclosure will be explained with reference to the circuit layout of the pixel circuits 110, 130, 150, 170 as shown in FIGS. 3, 5, 7 and 9 and the input signal timing sequence of the pixel circuits as shown in FIG. 14. Although P-type transistors are used in the pixel circuits 110, 130, 150, 170 as shown in FIGS. 3, 5, 7 and 9, it is easy to comprehend that N-type transistors may also be used if only corresponding adaptive modifications are made and corresponding gate voltage is adjusted, as long as the driving methods of the pixel circuits provided by the exemplary embodiments of the present disclosure can be realized. Hence, the exemplary embodiments of the present disclosure impose no limitations on the types of various thin-film transistors.

In the first phase t1, the reset signal Reset applied at the reset signal terminal RESET is at a low voltage, the scan signal applied at the scan signal terminal GATE is at a high voltage, and the light emitting signal em applied at the light emitting terminal EM is at a high voltage.

As far as the pixel circuits 110 and 130 are concerned, the reset signal Reset is at a low voltage, so the source and drain of the first transistor T1 are brought into conduction, such that the initialization voltage signal Vint may be used to initialize the potential at the first node N1. As far as the pixel circuits 150 and 170 are concerned, the reset signal Reset is at a low voltage, so the source and drain of the first transistor T1 are brought into conduction and the source and drain of the sixth transistor T6 are brought into conduction, such that the initialization voltage signal Vint may be used to initialize the potentials at the first node N1 and the second node N2. Furthermore, as far as the pixel circuits 110, 130, 150 and 170 are concerned, the potential at the gate of the driving transistor DTFT at this time is the voltage of the initialization voltage signal Vint.

In the second phase t2, the reset signal Reset is at a high voltage, the scan signal Gate is at a low voltage and the light emitting signal em is at a high voltage.

As far as the pixel circuits 110 and 130 are concerned, the scan signal Gate is at a low voltage, so the source and drain of the second transistor T2 are brought into conduction, and the third transistor T3 at this time is in a diode state, such that the storage capacitor Cst may be charged by utilizing the data signal via the source and gate of the third transistor T3, and therefore the potential at the first node N1 is set to be the difference between the voltage Vdata of the data signal and the threshold voltage Vth3 of the third transistor T3, i.e., Vdata−Vth3. Then, the storage capacitor Cst maintains the potential at the first node N1 at Vdata−Vth3. As far as the pixel circuits 150 and 170 are concerned, the scan signal Gate is at a low voltage, the source and drain of the second transistor T2 are brought into conduction, the source and drain of the fifth transistor T5 are also brought into conduction, and the third transistor T3 at this time is in a diode state, such that the storage capacitor Cst may be charged by utilizing the data signal via the source and gate of the third transistor T3. Likewise, the potential at the first node N1 is set to be Vdata−Vth3, and then the storage capacitor Cst maintains the potential at the first node N1 at Vdata−Vth3. Thus, as far as the pixel circuits 110, 130, 150 and 170 are concerned, the potential at the gate (i.e., the first node N1) of the driving transistor DTFT at this time is the difference between the voltage Vdata of the data signal and the threshold voltage Vth3 of the third transistor T3.

In the third phase t3, the reset signal Reset is at a high voltage, the scan signal Gate is at a high voltage and the light emitting signal em is at a low voltage.

As far as the pixel circuits 110, 130, 150 and 170 are concerned, the light emitting signal em is at a low voltage, so the source and drain of the fourth transistor T4 are brought into conduction, and the driving transistor DTFT may be used to drive the organic light emitting diode 30. Since, in the second phase t2, the threshold voltage of the driving transistor DTFT is compensated at the gate of the driving transistor DTFT (i.e., the potential at the first node N1 is set and maintained at Vdata−Vth3), according to the above formula, the threshold voltage Vth of the driving transistor DTFT will be counteracted when the driving current $I_{OLED}$ is generated, such that the driving current $I_{OLED}$ flowing towards the OLED 30 is only relevant to the difference between the voltage VDD at the first voltage terminal V1 and the voltage Vdata of the data signal, and irrelevant to the threshold voltage of the driving transistor DTFT.

Therefore, with the pixel circuits provided in the embodiments of the present disclosure, the difference between the voltage of the data signal and the threshold voltage of the third switching unit can be written into the control terminal of the driving unit before the light emitting device emits light, thereby eliminating the influence of the variation in the threshold voltage of the driving unit on the light emission. Moreover, a circuit configuration can be achieved with a relatively small storage capacitor. Thus, the pixel circuits provided by the exemplary embodiments of the present disclosure may realize a smaller pixel layout, enhance the display resolution, and improve the uniformity of a displayed image. Moreover, by appropriately shunting the driving current flowing towards the light emitting device, the pixel circuits provided by the exemplary embodiments of the present disclosure may also improve the display effect of the low-brightness image, and thereby the contrast of the displayed image.

The above contents are only exemplary embodiments of the present disclosure, but the scope of the present disclosure is not limited thereto. As far as those ordinarily skilled in the art are concerned, various variations and modifications can be made without departing from the spirit and essence of the present disclosure. These variations and modifications are regarded as falling within the protection scope of the present disclosure. Thus, the scope of the present disclosure is determined based upon the scopes of the appended claims.

What is claimed is:

1. A pixel circuit, comprising:

a first voltage terminal configured to be applied with a first voltage signal;

a second voltage terminal configured to be applied with a second voltage signal;

an initialization voltage terminal configured to be applied with an initialization voltage signal;

a scan signal terminal configured to receive a scan signal;

a data signal terminal configured to receive a data signal;

a reset signal terminal configured to receive a reset signal;

a light emitting signal terminal configured to receive a light emitting signal;

a light emitting device, a storage capacitor, a driving unit, a first switching unit, a second switching unit, a third switching unit, a fourth switching unit, a fifth switching unit and a sixth switching unit, wherein:

each of the switching units comprises a control terminal, a first signal terminal and a second signal terminal, the control terminal of the switching unit is operable to bring the first and second signal terminals into or out of conduction, and the driving unit comprises a control terminal, a signal input terminal and a drive terminal, the control terminal and the signal input terminal of the driving unit is operable to control a drive signal outputted at the drive terminal;

the control terminal of the driving unit, a first terminal of the storage capacitor, the first signal terminal of the first switching unit, the first signal terminal of the second switching unit and the control terminal of the third switching unit are connected to a first node;

the control terminal of the second switching unit and the control terminal of the fifth switching unit are connected to the scan signal terminal, the second signal terminal of the second switching unit is connected with the first signal terminal of the third switching unit, the second signal terminal of the third switching unit is connected with the first signal terminal of the fifth switching unit, and the second signal terminal of the fifth switching unit is connected with the data signal terminal;

the control terminal of the first switching unit and the control terminal of the sixth switching unit are connected to the reset signal terminal, and the second signal terminal of the first switching unit and the first signal terminal of the sixth switching unit are connected to the initialization voltage terminal;

the control terminal of the fourth switching unit is connected to the light emitting signal terminal, a second terminal of the storage capacitor is connected to the first voltage signal terminal, a first terminal of the light emitting device and the second signal terminal of the sixth switching unit are connected to a second node, and a second terminal of the light emitting device is connected with the second voltage signal terminal; and the signal input terminal and the drive terminal of the driving unit as well as the first signal terminal and the second signal terminal of the fourth switching unit are connected in series between the first voltage signal terminal and the second node, such that the driving unit and the fourth switching unit are connected in series between the first voltage signal terminal and the second node.

2. The pixel circuit of claim 1, wherein the driving unit and six switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

3. The pixel circuit of claim 2, wherein the driving unit and the six switching units are P-type thin film transistors.

4. The pixel circuit of claim 2, wherein the driving unit and the six switching units are N-type thin film transistors.

5. The pixel circuit of claim 1, wherein the driving unit and the third switching unit are thin film transistors having the same specifications.

6. The pixel circuit of claim 1, wherein the light emitting device is an organic light emitting diode.

7. A display substrate comprising the pixel circuits of claim 1 and a base substrate supporting the pixel circuits.

8. A display apparatus comprising the display substrate of claim 7.

9. The display apparatus of claim 8, wherein the driving unit and the six switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

10. The display apparatus of claim 9, wherein the driving unit and the six switching units are P-type thin film transistors.

11. The display apparatus of claim 9, wherein the driving unit and the six switching units are N-type thin film transistors.

12. The display apparatus of claim 8, wherein the driving unit and the third switching unit are thin film transistors having the same specifications.

13. The display apparatus of claim 8, wherein the light emitting device is an organic light emitting diode.

14. The display substrate of claim 7, wherein the driving unit and the six switching units are thin film transistors, wherein:

the control terminal of each of the switching units and the control terminal of the driving unit are each a gate of the thin film transistor;

the first signal terminal and the second signal terminal of each of the switching units are a source and a drain of the thin film transistor, respectively; or the first signal terminal and the second signal terminal of each of the switching units are a drain and a source of the thin film transistor, respectively; and the signal input terminal and the drive terminal of the driving unit are a source and a drain of the thin film transistor, respectively; or the signal input terminal and the drive terminal of the driving unit are a drain and a source of the thin film transistor, respectively.

15. The display substrate of claim 14, wherein the driving unit and the six switching units are P-type thin film transistors.

16. The display substrate of claim 14, wherein the driving unit and the six switching units are N-type thin film transistors.

17. The display substrate of claim 7, wherein the driving unit and the third switching unit are thin film transistors having the same specifications.

18. The display substrate of claim 7, wherein the light emitting device is an organic light emitting diode.

19. A driving method for the pixel circuit of claim 1, the driving method comprising:

bringing the first and second signal terminals of the first switching unit into conduction, bringing the first and second signal terminals of the sixth switching unit into conduction, and initializing the potentials at the first node and the second node with the initialization voltage;

bringing the first and second signal terminals of the second switching unit into conduction, bringing the first and second signal terminals of the fifth switching unit into conduction, and charging the storage capacitor with the data signal via the second signal terminal and the control terminal of the third switching unit to set the potential at the first node; and bringing the first and second signal terminals of the fourth switching unit into conduction, and driving the light emitting device by the driving unit.

20. The driving method of claim 19, wherein the driving unit is a thin film transistor, and wherein, when driving the light emitting device, the thin film transistor serving as the driving unit is in a saturated state.

* * * * *